US006030249A

United States Patent [19]

Illg

[11] Patent Number: 6,030,249

[45] Date of Patent: Feb. 29, 2000

[54] MOLDED CONNECTOR WITH METAL HOLDER

[75] Inventor: Manfred Illg, Weinstadt, Germany

[73] Assignee: ITT Manufacturing Enterprises, Inc., Wilmington, Del.

[21] Appl. No.: 08/908,671

[22] Filed: Aug. 7, 1997

[30] Foreign Application Priority Data

Aug. 8, 1996 [DE] Germany ..... 296 13 694 U

[51] Int. Cl.[7] ..... H01R 13/627

[52] U.S. Cl. ..... 439/353; 439/570

[58] Field of Search ..... 439/353, 357, 439/570, 567, 563

[56] References Cited

U.S. PATENT DOCUMENTS

| | | | |
|---|---|---|---|
| 4,688,871 | 8/1987 | Nakazawa et al. | 439/357 |
| 4,826,442 | 5/1989 | Douty et al. | 439/92 |
| 5,021,002 | 6/1991 | Noschese | 439/352 |
| 5,232,379 | 8/1993 | Lai | 439/570 |
| 5,234,357 | 8/1993 | Yamaguchi | 439/354 |
| 5,259,789 | 11/1993 | Patel et al. | 439/570 |
| 5,334,049 | 8/1994 | Kachlic et al. | 439/567 |
| 5,340,329 | 8/1994 | Hirai | 439/357 |
| 5,354,214 | 10/1994 | Aso et al. | 439/492 |
| 5,454,729 | 10/1995 | Wen-Te | 439/357 |
| 5,468,154 | 11/1995 | Yip et al. | 439/79 |
| 5,533,908 | 7/1996 | Henry et al. | 439/329 |

FOREIGN PATENT DOCUMENTS

| | | |
|---|---|---|
| 0 373 905 A1 | 12/1989 | European Pat. Off. . |
| 0 691 712 A1 | 6/1995 | European Pat. Off. . |
| 35 38 457 C2 | 10/1985 | Germany . |
| 36 03 250 C2 | 2/1986 | Germany . |
| 37 34 607 C1 | 10/1987 | Germany . |
| 88 04 956 U | 4/1988 | Germany . |
| 90 00 704 U | 1/1990 | Germany . |
| 90 04 483 U | 4/1990 | Germany . |
| 41 12 030 C2 | 4/1991 | Germany . |
| 195 00 102 A1 | 1/1995 | Germany . |
| 93/02489 | 7/1992 | WIPO . |
| 96/07221 | 7/1995 | WIPO . |

*Primary Examiner*—Renee S. Luebke
*Assistant Examiner*—Javaid Nasri
*Attorney, Agent, or Firm*—Thomas L. Peterson

[57] ABSTRACT

A plug-receiving electrical connector is described, which includes a molded plastic housing (12) with a forwardly-opening cavity (16) for receiving a plug (11), which includes one-piece metal holders (13, 14) that directly engage latches (67) on the plug and that directly fix the connector to a circuit board (15). Each one-piece holder is formed of sheet metal and has a main part (45) lying in a vertical plane (82) and a strike (47) extending from a forward edge (84) of the main part and bent 90° about a vertical axis (100). The housing has side walls (26, 27) that each have a vertical slot (31, 32) that enables the holder main part to pass completely through the slot so a bottom portion (94) of the holder can directly engage the circuit board, and so the strike can project into the plug-receiving cavity to directly engage the plug latch. Each side wall is formed with a protrusion (22) that lies against the forward surface of the strike to support it.

5 Claims, 5 Drawing Sheets

MOLDED CONNECTOR WITH METAL HOLDER

BACKGROUND OF THE INVENTION

Plug connectors such as the type used in mobile phones, are offered in progressively smaller sizes. However, the forces applied by the plug to the connector during plugging in and pull out of the plug, remain high. Sheet metal parts can be easily bent only in certain directions, and provide a wear-resistant strike for holding a plug and provide a high strength means for attachment to a circuit board by soldering to a surface of a circuit board and/or penetrating through a hole in the circuit board. However, such metal parts must be securely mounted to the molded plastic housing of the connector and should minimize stresses on the plastic housing when plugging and pull out forces are applied.

SUMMARY OF THE INVENTION

In accordance with one embodiment of the present invention, a plug-engaging electrical connector and a holder therefor are provided, which enables reliable transfer of forces between a plug that is being mated or unmated from the connector and a circuit board on which the connector is mounted. The connector includes a molded plastic housing with opposite side walls and with a cavity formed between them into which the plug is inserted. Each housing side wall has a vertical slot, and a metal holder extends downwardly through the slot. The holder has a laterally-extending strike that projects into the cavity to directly engage a latch on the plug and receive forces when the plug is pulled. The holder has a bottom that projects below the housing and that is fixed to the circuit board. Thus, forces transmitted by the plug to the housing are transferred from the strike to the bottom portion of the holder and to the circuit board entirely through the one-piece metal holder.

The housing has a lateral slot that receives the strike, and has a projection that projects into the cavity, with the projection having a rear surface that lies facewise against the metal strike. Accordingly, when the plug is pulled forwardly, the forces are transmitted through the metal strike to the projection so the plastic projection can resist bending of the strike. Forces are transmitted from the strike to the bottom portion of the holder and from there to the circuit board. The holder is closely received in the side wall slot, so much of the forces on the holder are resisted by shear forces on the metal holder, which even a thin metal holder can withstand.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
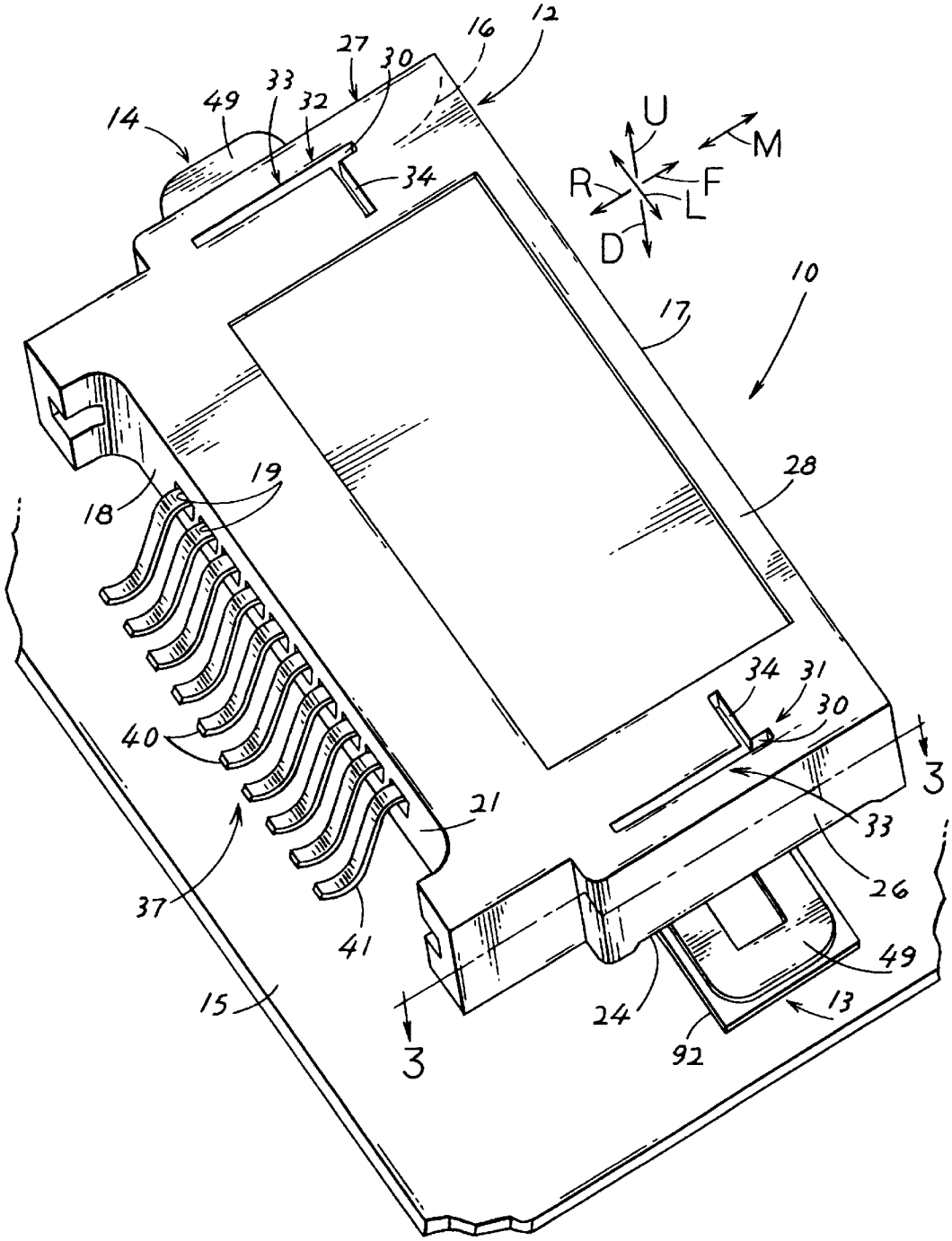
FIG. 2 is a rear isometric view of the connector of FIG. 1.

FIG. 2 illustrates an electrical connector 10 that is mounted on a circuit board 15 of electrical equipment such as a mobile telephone. The connector includes a molded plastic housing 12 that has a plug-receiving cavity 16 opening in a forward direction F. A plurality of contacts 41 of a contact arrangement 37 is mounted on the housing, with contact tails 40 extending from a rear wall 21 of the housing and soldered to traces on the circuit board. The housing is securely held to the circuit board by a pair of holders 13, 14. The holders have portions lying in slots 31, 32 formed in side walls 26, 27 of the housing. Each holder also has portions fixed to the circuit board, with FIG. 2 showing a solder tab 49 of holder 13 that is soldered to a trace 92 on the circuit board. The opposite side walls 26, 27 are spaced in a lateral direction L. Front and rear ends 17, 18 of the housing are spaced in a longitudinal direction M which is parallel to forward and rearward arrows F, R. Arrows U, D represent up and down directions.

Figure 1:
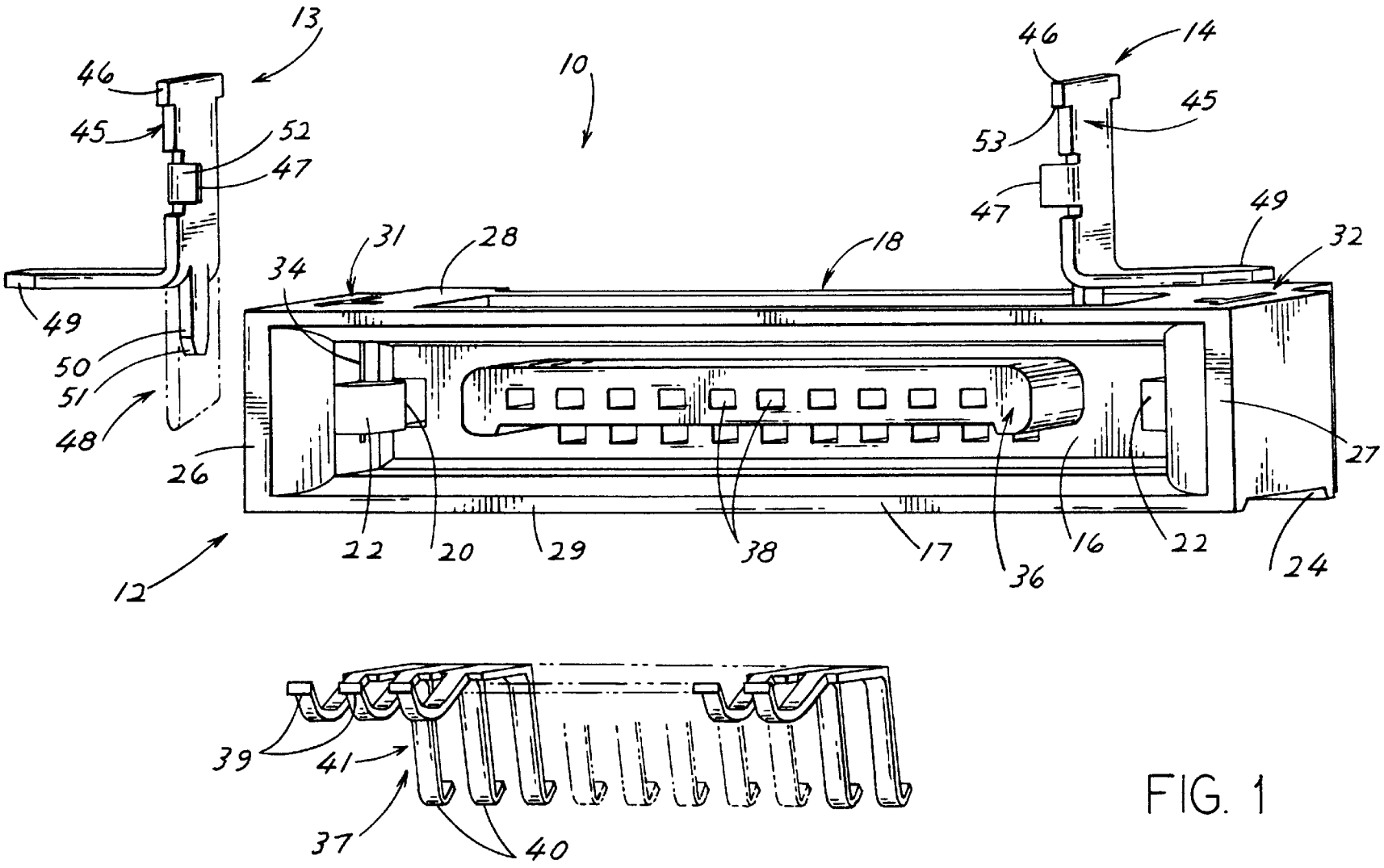
FIG. 1 is an exploded isometric view of a plug-receiving connector constructed in accordance with the present invention.

FIG. 1 shows the cavity 16 formed by top and bottom walls 28, 29 of the housing as well as the side walls 26, 27. A housing portion 36 lying in the cavity has recesses 38 that receive mating ends 39 of the contacts 41. The slot 31, 32 in each side wall includes a transverse portion 34 that opens to the cavity 16 at a location immediately behind a protrusion 22.

Figure 1A:
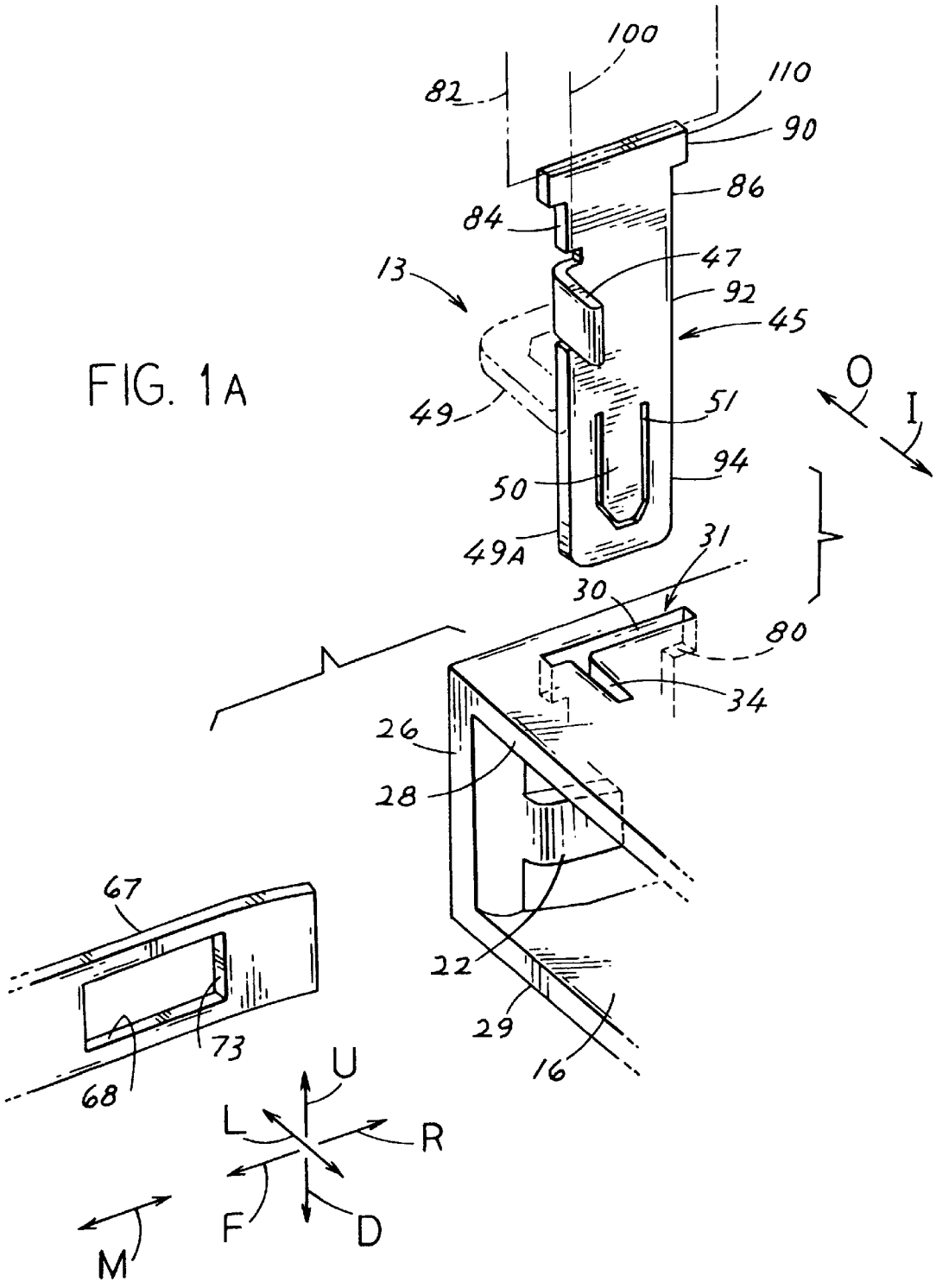
FIG. 1A is an exploded view of a portion of the connector of FIG. 1 and showing a latch of a plug that can be inserted into the connector.

FIG. 1A shows the shape of the holder 14, which is formed of sheet metal and which includes a main part 45 that lies in a vertical plane 82 which extends in the longitudinal directions M and up and down directions U, D (it is normal to the lateral direction L). The main part 45 includes an upper portion 90, a middle portion 92, and a bottom portion 94. The middle portion has forward and rearward edges 84, 86, and a strike 47 extends from the forward edge and is bent by 90° about a vertical axis 100 to extend in an inward lateral direction l. The slot 32 includes a main slot portion 30 that extends longitudinally (M) and that receives the main part 45, and a transverse slot portion 34 that extends transversely (laterally L) and that can pass the strike 47. The bottom portion of the holder main part includes a pin 50 that lies within a hole 51 of a solder tab shown at 49A prior to bending it to its final position at 49. The holder 14 in the position shown in solid lines in FIG. 1A, is installed by pushing it down into the vertical slot 32, until longitudinal bosses or projections 110 at the upper portion 90 rest against shoulders 80 formed in an upper portion of the vertical slot. The strike 47 then lies immediately rearward of the housing projection 22. Also, the solder tab 49A projects below the bottom wall 29 of the housing and can be bent about 90° to the position 49 wherein it can lie against a trace on the circuit board. The pin 50 then can project through a hole in the circuit board. A mating plug has a plug latch 67 that can be inserted in the rearward direction R into the cavity until a blocking recess 68 in the latch receives the projection 22 and the strike 47.

Figure 4:
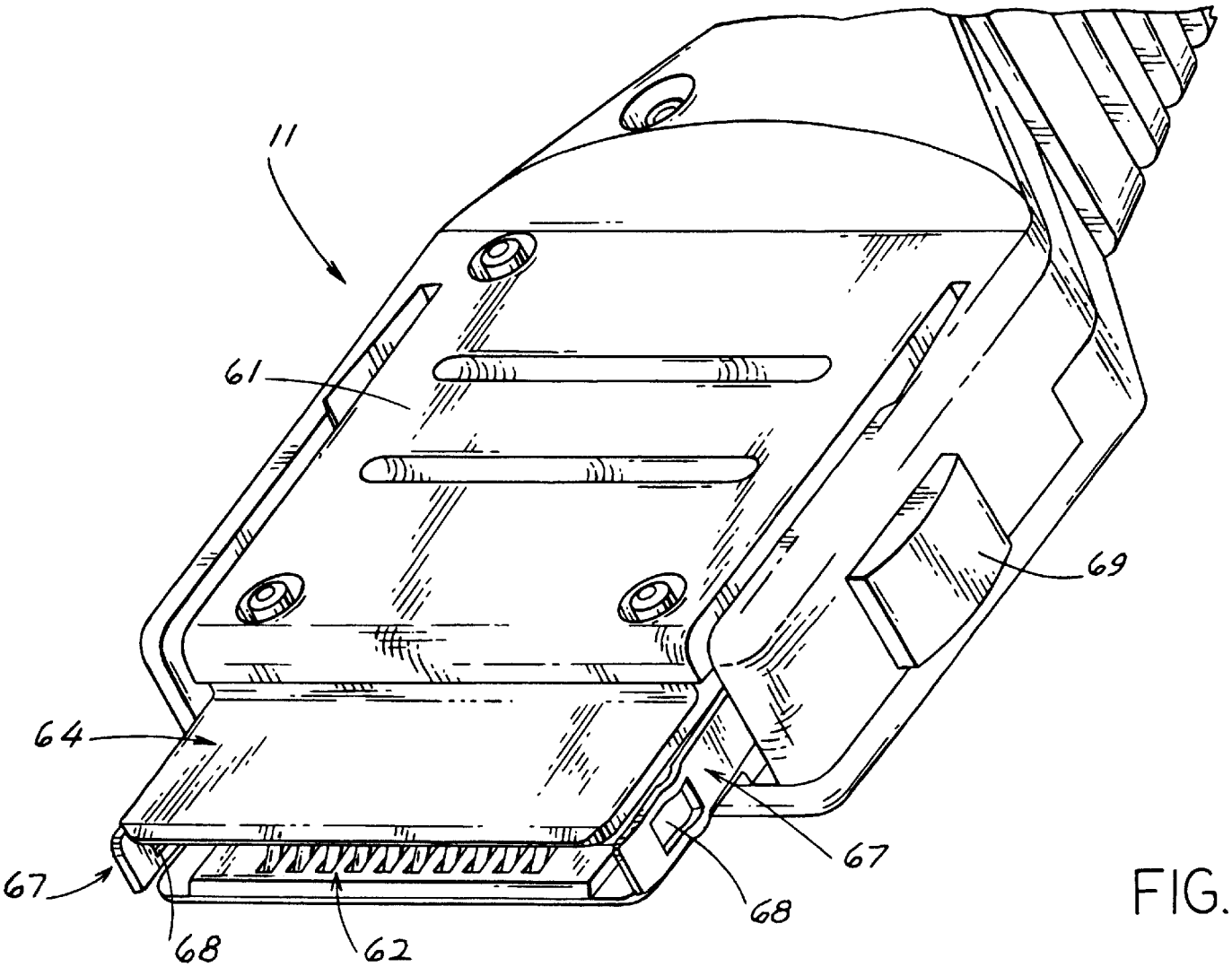
FIG. 4 is an isometric view of a plug designed for engagement with the connector of FIGS. 1–3.

FIG. 4 shows the plug 11, which has a frame 61, with a plug part 64 that holds plug terminals 62. Latches 67 at laterally opposite sides of the plug part can be deflected toward each other for unlatching, by depression of handles 69. The plug can be electrically connected to a ground on the circuit board through the holders.

Figure 3:
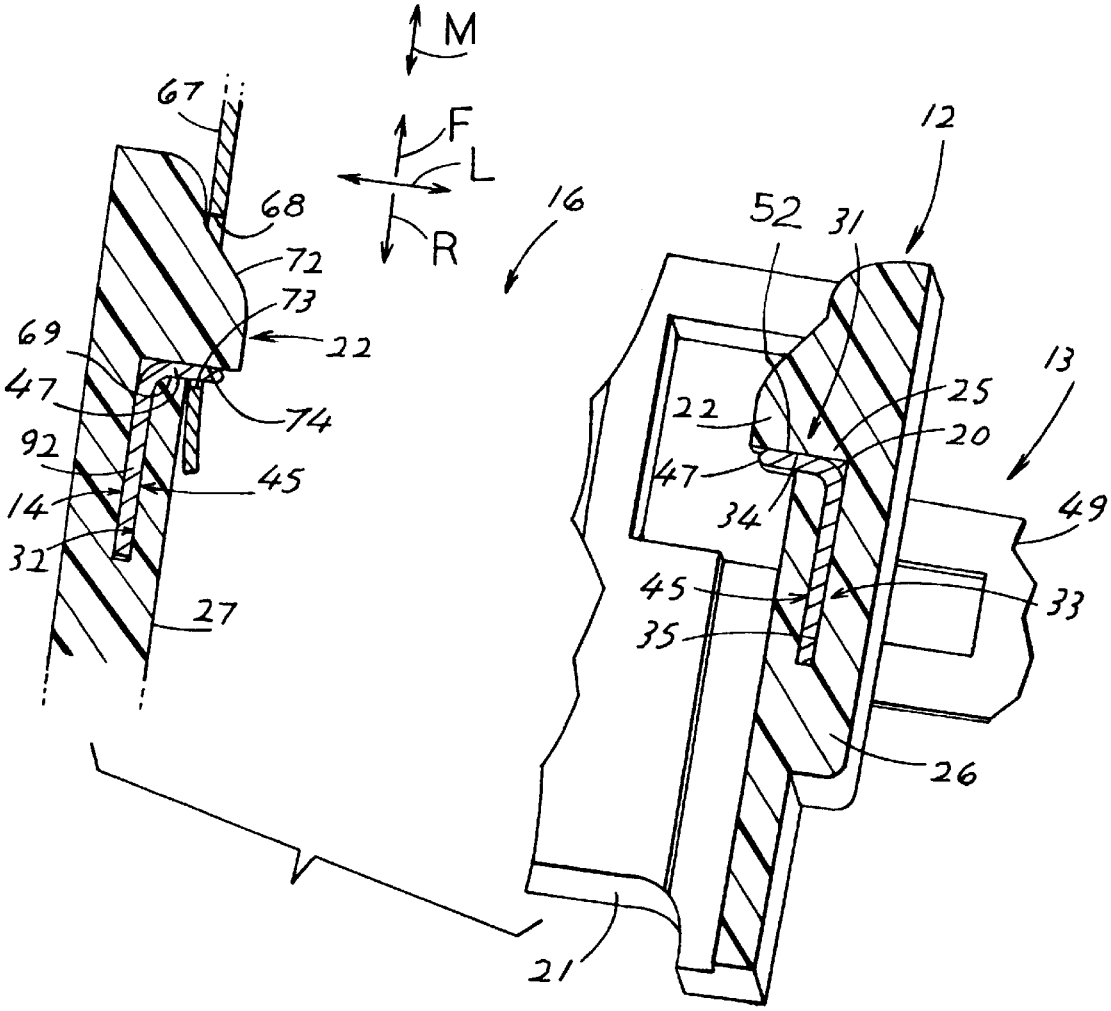
FIG. 3 is a sectional view taken on line 3—3 of FIG. 2, and showing both side walls of the connector housing and showing a plug latch fully engaged at one side of the housing.

FIG. 3 shows the two holders 13, 14 lying in the slots 31, 32 in the opposite side walls 26, 27. It can be seen that each strike 47 has a front face 69 that lies immediately behind a rear face 74 of a corresponding projection 22. The projection has a forward face leadin surface 72 that is inclined from both the lateral L and longitudinal M directions to guide the plug latch 67 and deflect it until it reaches the position shown in FIG. 3. The projection 22 projects further inward than the strike. When the latch 67 is pulled in the forward direction F, a rear edge 73 of the latch recess 68 presses directly against the strike 47. Forces applied to the strike 47 are transmitted to the middle portion 92 of the holder, and transmitted from it to the pin 50 (FIG. 1A) and solder tab 49 to the circuit board. Probably the largest forces applied to the connector are forces applied during pull out of the plug when the latch 67 is pulled in the forward direction F. The strike 47 takes such forces and distributes them over the area of the rear face 74 of the projection 22, which transmit them to the holder main part 45. The holder 14 is formed of metal such as steel that can readily withstand such local forces applied to it by the latch and any resulting wear. The fact that the middle portion 92 lies in a longitudinal plane, results in primarily shear forces carried by the middle portion 92 down to pin 50 and solder tab 49. While thin sheet metal cannot withstand large bending forces, it can withstand large shear forces.

FIG. 2 shows that the bottom of each side wall has a recess 24 through which the solder tab 49 projects, to allow surrounding portions of the housing bottom to lie directly against the upper surface of the circuit board 15.

The two holders 13, 14 shown in FIG. 1 can be formed from identical pieces of sheet metal that have been punched from a blank. However, the strikes of the two preforms are bent in opposite directions. Of course, the solder tabs 49 are later bent in opposite directions to project laterally from a corresponding side of the housing. The use of a single or one-piece holder 13, 14 at each side of a housing, minimizes the cost of the holders, facilitates mounting them on the housing, and enables direct transmission of forces from a plug through the holder (backed by the housing projection) to the circuit board. The housing 12 is preferably injection molded of a plastic, or polymer, with cores being used to form the slots in the side walls.

While terms such as "vertical", "upper", "lower", etc. have been used to aid in describing the invention as illustrated, it should be understood that the connector and its parts can be used in any orientation with respect to the Earth.

Thus, the invention provides a plug-receiving electrical connector with a molded plastic housing and metal holders that directly receive latching forces of the plug and that directly engage the circuit board to transmit forces between them. Each holder extends through a slot in a side wall of the housing, and has a strike that lies in the plug-receiving cavity and has a part that engages the circuit board. Each holder is preferably formed of sheet metal, with the strike lying behind a protrusion formed in the housing, so the thick molded housing protrusion provides stiffness to resist bending of the strike while the rest of the strike can resist plug pull out forces primarily by resistance to shear.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A combination of an electrical connector and a circuit board, comprising:

a molded polymer housing having opposite vertically-extending first and second side walls that are spaced in a lateral direction and having at least a top wall with said housing forming a longitudinally forwardly opening plug-receiving cavity between them that opens in a forward longitudinal direction, said first side wall having a vertical slot therein that includes a main slot part that is elongated in said longitudinal direction and that extends vertically completely through the first wall and a lateral slot part that is narrow and is elongated in said lateral direction and that extends perpendicular to said main slot part and that opens to said cavity;

a sheet metal holder that has a main part lying in said longitudinal vertical plane and extending through said slot main part and having a lower part fastened to said circuit board, said holder having a strike that extends from said slot main part and that is bent about a vertical axis and that projects through said lateral slot part and into said cavity and that forms a rearwardly-facing strike surface at one side of said cavity.

2. The combination described in claim 1 wherein:

said housing first side wall forms a protrusion lying directly in front of said strike, said protrusion having a front forming an inclined leadin surface and having a rear that lies against said strike to support it.

3. The combination described in claim 2 wherein:

said protrusion projects further into said cavity than said strike.

4. A plug-engaging electrical connector which includes a housing with laterally opposite side walls and top and bottom walls, where the housing can be mounted on a circuit board positioned under the housing, and the connector also includes a plurality of contacts mounted in the housing, where the housing has a forwardly-opening cavity with opposite sides for receiving a plug that has laterally opposite plug sides with a plug latch at at least one of said plug sides, wherein:

said housing is formed of a molded polymer and a first of said housing side walls includes a protrusion that protrudes into said cavity, with said protrusion having an inclined surface portion and a rear face;

said connector includes at least one holder formed of a single piece of metal;

the first of said housing side walls has a vertical slot with a slot portion that extends vertically through said first side wall and with a portion opening to a corresponding side of said cavity;

said holder extends through said slot and has a board-engaging portion that lies below the housing bottom wall for attaching to the circuit board, with said holder having a strike that lies in said cavity at one of said side walls thereof for engaging the plug latch, with said strike lying against said rear face of said protrusion to be backed by said protrusion.

5. A plug-engaging electrical connector which includes a housing with laterally opposite side walls spaced in a lateral direction and top and bottom walls, where the housing can be mounted on a circuit board positioned under the housing, and the connector also includes a plurality of contacts mounted in the housing, where the housing has a forwardly-opening cavity with opposite sides for receiving a plug that has laterally opposite plug sides with a plug latch at at least one of said plug sides, wherein:

said housing is formed of a molded polymer and a first of said housing side walls includes a protrusion that protrudes into said cavity, with said protrusion having an inclined surface portion and a rear face;

the first of said housing side walls has a vertical slot with a slot portion that extends vertically through said first side wall and with a portion opening to a corresponding side of said cavity;

said connector including a holder that is formed of sheet metal, said holder extends through said slot and has a board-engaging portion that lies below the housing bottom wall for attaching to the circuit board, with said holder having a strike that lies in said cavity at one of said sides thereof for engaging the plug latch;

as seen in a plan view, said slot has a main slot portion (30) that extends in a plane (82) that is normal to said lateral direction, and said slot includes a transverse slot portion (34) that extends vertically primarily perpendicular to said main slot portion and that intersects said main slot portion;

said holder has a main part that lies in said main slot portion, and said strike extends primarily perpendicular to said main part and projects through said transverse slot portion into said cavity, with said transverse slot portion closely surrounding said strike to fix its position.

* * * * *